US006308546B1

(12) United States Patent
Blaimschein et al.

(10) Patent No.: US 6,308,546 B1
(45) Date of Patent: Oct. 30, 2001

(54) SWAGING MACHINE

(75) Inventors: Gottfried Blaimschein, Steyr; Alfred Seeber, Garsten/Steyr, both of (AT)

(73) Assignee: GFM Beteiligungs und Management GmbH & Co. KG, Steyr (DE)

( * ) Notice: Subject to any disclaimer, the term of this patent is extended or adjusted under 35 U.S.C. 154(b) by 0 days.

(21) Appl. No.: 09/456,006

(22) Filed: Dec. 7, 1999

(30) Foreign Application Priority Data

Dec. 7, 1998 (AT) ..... 2049/98

(51) Int. Cl.[7] ..... B21J 7/32
(52) U.S. Cl. ..... 72/76; 72/403
(58) Field of Search ..... 72/76, 402, 403

(56) References Cited

U.S. PATENT DOCUMENTS 3,066,555 * 12/1962 Burnel ..... 72/76

FOREIGN PATENT DOCUMENTS 404 441 11/1998 (AT) .

* cited by examiner

*Primary Examiner*—Lowell A. Larson
(74) *Attorney, Agent, or Firm*—Collard & Roe, P.C.

(57) ABSTRACT

A swaging machine (1) for swaging rod-shaped or tubular workpieces is comprised of an annular forging box (3) mounted in a machine frame (2) so as to be rotated and driven about the axis of movement (A) of the workpiece, where in radial recesses (4) of said forging box forging punches (5) are accommodated, which are acting against each other and are vertically movable via a lifting drive (7) while the forging box rotates at the same time. To achieve an economic adjustment of the vertical position also during the forging operation, the forging punches comprise two parts screw-connected with each other, a drive-end, rotatably guided upper part (51) and a tool-end, non-rotatably guided lower part (52), where the upper part (51) has associated thereto a transmission (20) with a gear rim (21) non-rotatably, but axially movably seated at the upper part (51) and rotatably, but axially immovably mounted in the forging box (3), and a drive gear (23) rotatably mounted in the forging box (3), which drive gears (23) are part of a planetary gear system (25).

4 Claims, 3 Drawing Sheets

SWAGING MACHINE

FIELD OF THE INVENTION

This invention relates to a swaging machine for swaging rod-shaped or tubular workpieces comprising an annular forging box mounted in a machine frame so as to be rotated and driven about the axis of movement of the workpiece, where in radial recesses of said forging box forging punches are accommodated, which are acting against each other and are vertically movable via a lifting drive while the forging box rotates at the same time.

DESCRIPTION OF THE PRIOR ART

With a comparatively simple machine concept, these swaging machines provide for swaging with forging tools radially striking against the workpiece and rotating relative to the workpiece, whereby an angular displacement of the deformation planes is obtained and zones of increased stress on the material in the overlap region of the tools are avoided. In the known swaging machines, however, an adjustment of the vertical position of the forging punches or the forging tools during a forging operation is only possible to a restricted extent by means of wedge plates for the forging punches divided into a drive-end ram and a tool-end tool carrier, so that the punch length and thus the vertical position of the tools can be adjusted by more or less inserting the wedge plates between ram and tool carrier.

SUMMARY OF THE INVENTION

It is therefore the object underlying the invention to create a swaging machine as described above, where the vertical position of the forging punches can be adjusted economically, and which also provides for larger adjustments of the vertical position during a forging operation.

This object is solved by the invention in that in a manner known per se the forging punches comprise two parts screw-connected with each other, a drive-end upper part rotatably guided in the forging box and a tool-end lower part non-rotatably guided in the forging box, where the upper part has associated thereto a transmission with a gear rim non-rotatably, but axially movably seated at the upper part and rotatably, but axially immovably mounted in the forging box, and a drive gear rotatably mounted in the forging box, which drive gears are part of a planetary gear system.

By dividing the forging punches into a rotatable upper part and a non-rotatable lower part screwed thereto, a simple and functionally reliable adjustment of the vertical position is possible, as a rotation of the upper part involves a change in length of the forging punch because of the screw connection with the lower part and accordingly changes the vertical position as desired. It should merely be ensured that the rotary movement of the upper part does not impair the lifting drive, which can be achieved in various ways depending on the respective kind of drive. For rotating the upper part there are provided transmissions including drive gears each associated to the upper parts, which drive gears cooperate with a suitable planetary gear system, so that an adjustment of the vertical position can be achieved via a corresponding drive of the planetary gear system. The transmission for the drive connection of drive gear and gear rim preferably is a worm gear, where the worm wheel forms the gear rim and the worm cooperating with the worm wheel is in drive connection with the drive gear. In a simple and economic way it is therefore possible to change the respective vertical position of the forging tools, which adjustment of the vertical position can be performed both during the down-time of the machine and during the operation of the machine.

A simple construction is obtained when the planetary gear system has a sun wheel rotatably and drivably mounted at the forging box coaxial to the axis of movement, with which sun wheel the drive gears rotatable about an axis of rotation parallel to the axis of movement are meshing as planet wheels. When the sun wheel rotates with the same rotational speed as the forging box, there is no rotation relative to the drive gears, and the vertical position of the forging punches remains unchanged. But when the sun wheel is rotated relative to the machine box, the transmissions and thus the upper part of the forging punches are rotated via the drive gears and there is an adjustment of the vertical position.

When the drive gears of the transmissions of two forging punches disposed opposite each other each have associated thereto their own planetary gear system, the vertical position of pairs of forging punches can be adjusted differently, in that the respectively associated transmissions are driven differently, which is for instance expedient when forging tubular workpieces over an arbor, so that by forging a slightly oval cross-section forging the workpiece onto the arbor can be prevented.

In principle, the vertical position adjusting means can be combined with any suitable lifting drive, when the rotatability of the upper part of the forging punch is ensured. It is, however, particularly advantageous when an eccentric drive is provided as lifting drive for the forging punches and, to effect a drive connection, the forging punches form a slide face for a sliding block rotatably seated at the eccentric on the end face of the upper part facing the eccentric, where upper part and sliding block are purely frictionally connected with each other, and pressure springs supported at the forging box on the one hand and at flange projections of the lower part on the other hand pressurize the forging punches and urge the upper parts and their slide faces against the sliding blocks. This lifting drive not only utilizes the advantages of an eccentric drive for the lifting drive, but because of the lack of a positive connection between upper part and sliding block, the forging punch can not only be moved transversely but can also be rotated, so that without additional relatively rotatable coupling parts or the like the adjustment of the vertical position can also be performed during the operation. In addition, the proper use of the forging tools on the one hand and the perfect application of pressure via the pressure springs on the other hand are ensured because of the non-rotatable lower part, where by a corresponding adaptation of the spring excursion or the bias of the pressure springs possibly required changes in the application of pressure can be compensated.

BRIEF DESCRIPTION OF THE DRAWING

In the drawing, the subject-matter of the invention is represented by way of example, wherein.

DESCRIPTION OF THE PREFERRED EMBODIMENT

Figure 1:
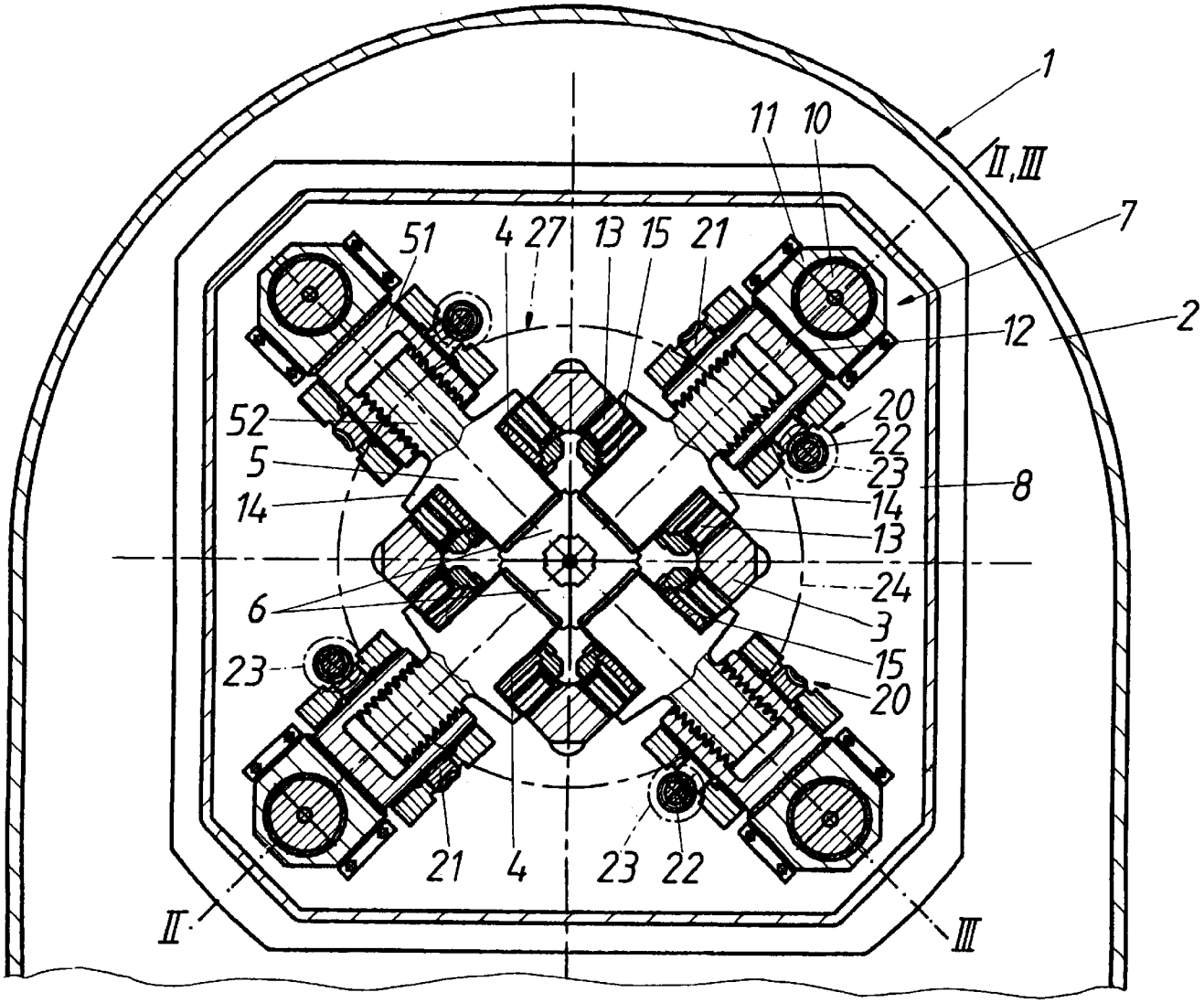
FIG. 1 shows an inventive forging machine in a cross-section along line I—I of FIG. 2.
Figure 2:
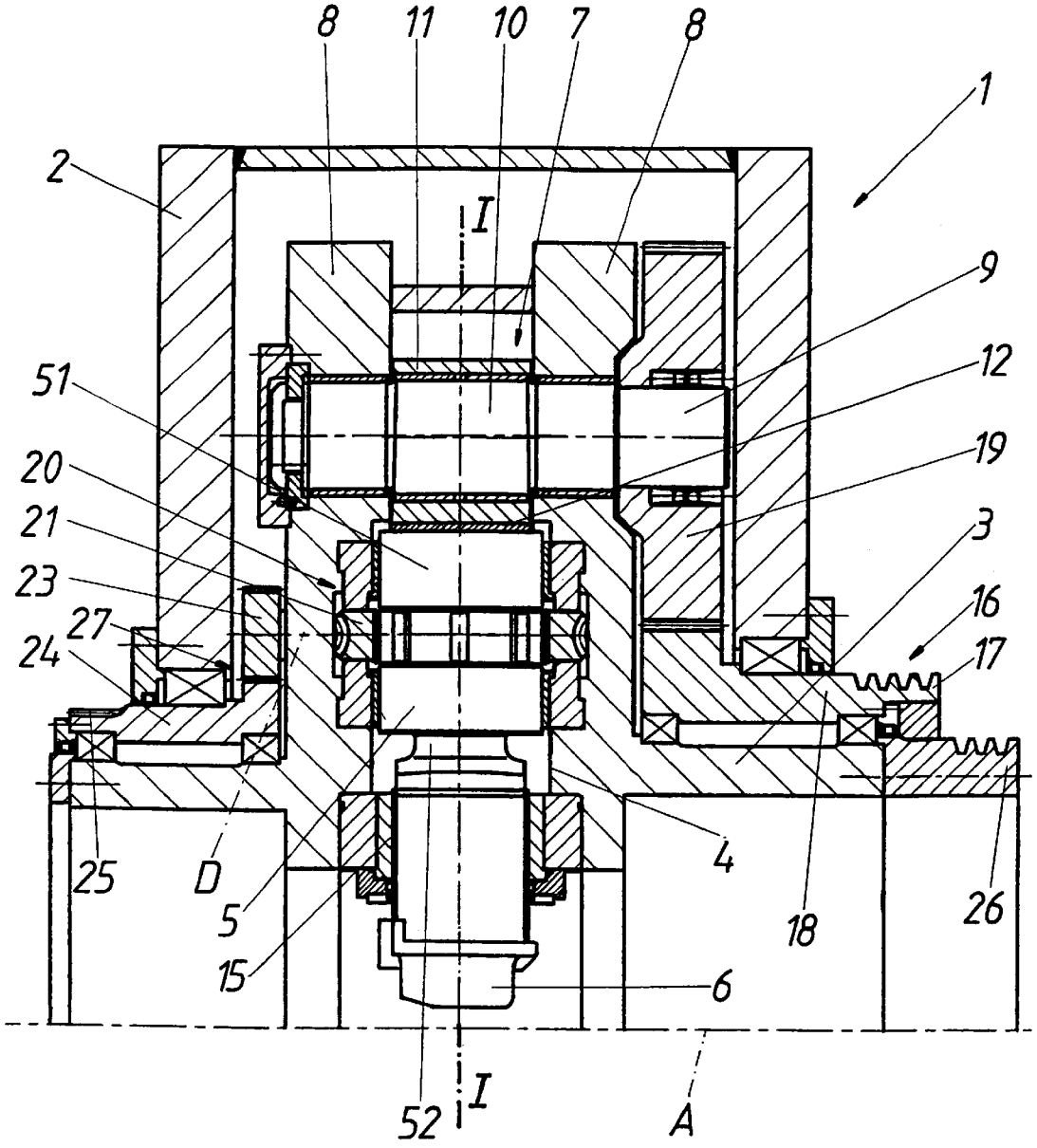
FIG. 2 shows an axial section on a larger scale along line II—II of FIG. 1.

A swaging machine 1 for swaging rod-shaped or tubular workpieces is comprised of a machine frame 2 in which an annular forging box 3 is mounted so as to be rotated and driven about the axis of movement A of the workpiece. The forging box 3 has radial recesses 4 for accommodating forging punches 5 acting against each other and vertically movable while the forging box rotates at the same time, which forging punches are equipped with a forging tool 6 at their end facing the workpiece, and at their end facing away from the workpiece are equipped with a lifting drive designed as eccentric drive 7. The eccentric drive 7 comprises eccentric shafts 9 associated to the forging punches 5 and mounted in annular walls 8 of the forging box 3, which eccentric shafts have eccentrics 10 on which sliding blocks 11 cooperating with the forging punches 5 are rotatably seated. To effect a drive connection, the forging punches 5 form a slide face 12 for the sliding blocks 11 at their end face facing the eccentric, where sliding block 11 and forging punch 5 are purely frictionally connected with each other, and the forging punches 5 are pressurized by pressure springs 13, preferably hydraulic springs, which are supported at the forging box 3 on the one hand and at flange projections 14 of the forging punches 5 on the other hand, and with their slide faces 12 are urged against the sliding blocks 11. The forging punches 5 are longitudinally guided in the forging box 3 via slide bars 15, so that in the case of a rotation of the eccentric a lifting movement radial to the axis of movement A is forced onto the forging punches 5 via the sliding blocks 11. For driving the eccentric shafts 9, there is provided a planetary gear system 16 comprising a sun wheel 18 rotatably mounted at the outer periphery of the forging box 3 and for instance drivable via a pulley 17 and planet wheels 19 each associated to the eccentric shafts 9.

To achieve a simple adjustment of the vertical position, the forging punches 5 have two parts screw-connected with each other, a drive-end upper part 51 rotatably guided in the forging box 3 and a tool-end lower part 52 non-rotatably guided in the forging box 3, so that a rotation of the upper part 51 leads to a change in length of the forging punch 5 as a result of the screw connection, and thus to an adjustment of the vertical position. For rotating the upper part 51 a transmission 20 is associated thereto, which has a gear rim 21, for instance a worm wheel, which is non-rotatably, but axially movably seated at the upper part 51 and rotatably, but axially immovably mounted in the forging box 3, and a worm 22 meshing with the worm wheel as well as a drive gear 23 mounted in the forging box 3 so as to be rotated about an axis of rotation D parallel to the axis of movement A for rotating the worm 22. The drive gears 23 are part of a planetary gear system 27 and are meshing with a sun wheel 24 coaxial to the axis of movement A and rotatably and drivably mounted at the forging box 3. Therefore, when the sun wheel 24 is rotated relative to the forging box 3 via an only indicated outer gear rim 25, the upper part 51 of the forging punches is also rotated via the drive gears 23 and thus an adjustment of the vertical position is performed. Since the upper part 51 forms the slide face 12 and the lower part 52 has the flange projections 14, the upper part can be rotated with respect to the sliding block without impairing the drive connection, and the pressure springs 13 can perfectly engage in the non-rotatably guided lower part 52.

Figure 3:
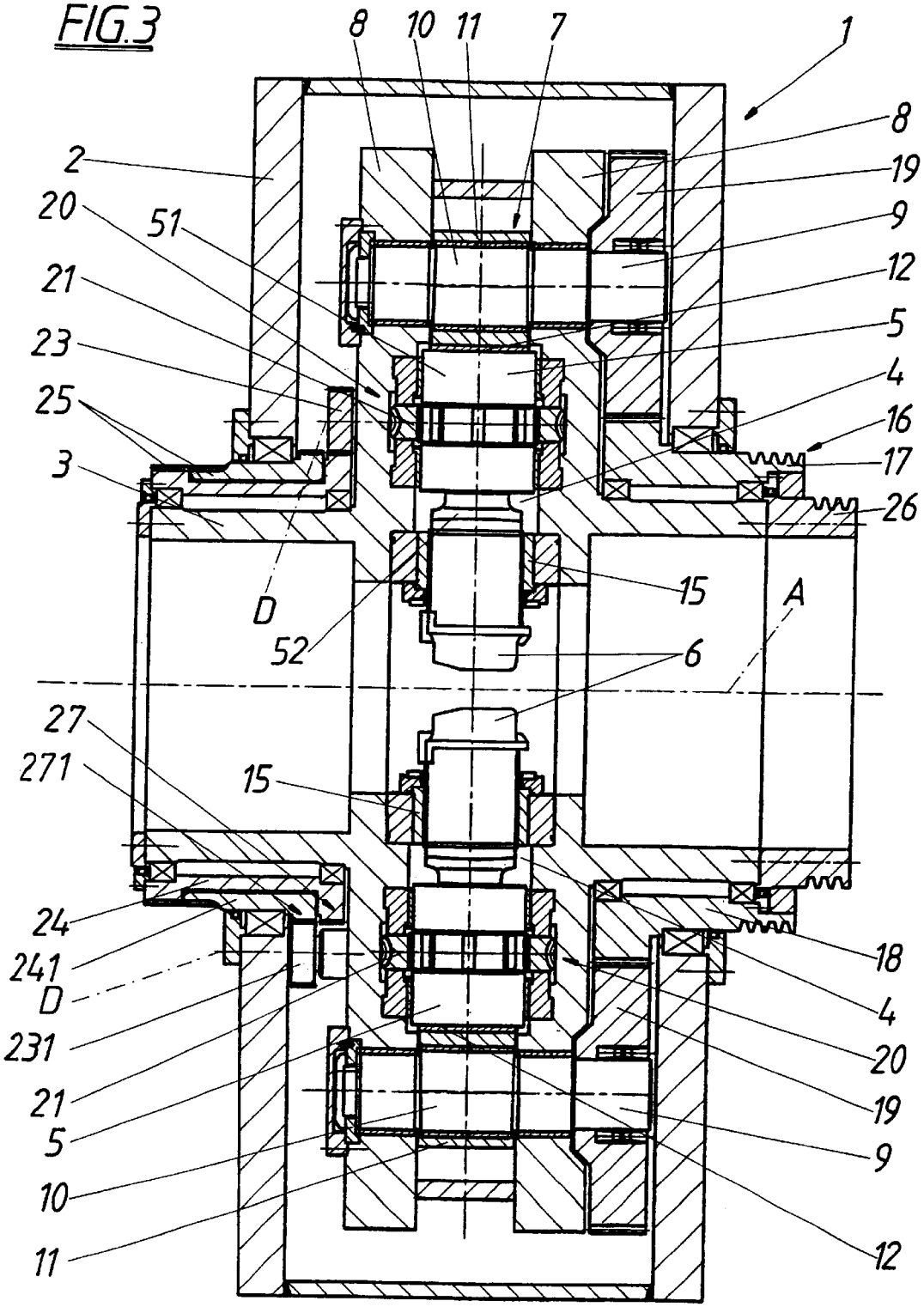
FIG. 3 shows a modified embodiment of an inventive forging machine in an axial section comparable to the axial section along line III—III of FIG. 1.

As is indicated in the embodiment shown in FIG. 3, a separate planetary gear system 27, 271 with central wheel 24, 241 may each be associated to the drive gears 23, 231 of the transmissions 20 of two forging punches 5 disposed opposite each other, so that by differently driving the two sun wheels 24, 241 the vertical positions of the forging punches 5 angularly offset with respect to each other are changed differently, and the swaging machine 1 can therefore optimally be adjusted to a tube forging over an arbor.

When the forging box 3 is only rotated by means of a drive 26 indicated as pulley, the eccentric drive 7 for the forging punches 5 can thus be actuated via the rotary drive 16 independent of this rotation of the forging box, whereby the forging punches 5 perform their lifting movement required for forging, while at the same time rotating about the axis of movement A. The rotation of the forging box on the one hand and the lifting movement of the forging punches on the other hand can then in addition be superimposed with a change in length of the forging punches 5 and thus an adjustment of the vertical position of the forging tools 6 via the sun wheel 24 or the sun wheels 24, 241, the drive gears 23 or 23 and 231 and the transmissions 20, so that swaging is not only possible with different vertical tool positions, but also with vertical tool positions changing during the forging operation.

What is claimed is:

1. A swaging machine for swaging rod-shaped or tubular workpieces, which comprises (a) a machine frame, (b) a forging box rotatably mounted in the machine frame to be driven about an axis of movement of the workpiece through the forging box, (c) forging punches mounted in radial recesses of the forging box, the forging punches acting against each other and being radially movable towards the axis of movement of the workpiece by a drive while the forging box is driven about the axis of movement, each forging punch comprising (1) a first part adjacent the drive and rotatably guided in the forging box, and (2) a second part adjacent the axis of movement of the workpiece and non-rotatably guided in the forging box, the first and second forging punch parts being screwed together, and (d) a transmission connected to the first forging punch part, the transmission including (1) a gear rim non-rotatably but axially movably seated on the first forging punch part and rotatably but axially immovably mounted in the forging box, and (2) a drive gear rotatably mounted in the forging box, the drive gears of the transmissions connected to the first parts of the forging punches forming part of a planetary gear system.

2. The swaging machine of claim 1, wherein the planetary gear system comprises a sun wheel mounted rotatably and drivably on the forging box and extending coaxially to the axis of movement of the workpiece, the drive gears being rotatable about an axis extending parallel to the axis of movement and meshing with the sun wheel as planet wheels.

3. The swaging machine of claim 1, wherein a separate one of the planetary gear systems is associated with each one of the drive gears of the transmissions of two of the forging punches disposed opposite each other.

4. The swaging machine of claim 1, wherein the drive for radially moving the forging punches is an eccentric drive, the forging punches being connected to the eccentric drive by a sliding block rotatably seated on an eccentric of the eccentric drive, the sliding block being arranged for sliding along a slide face on an end face of the forging punch facing the eccentric and the forging punch being only in frictional engagement with the sliding block, and further comprising a pressure spring supported on the forging box and on a flange projection of the second forging punch part for biasing the forging punch to press the slide face against the sliding block.

* * * * *